US011026454B2

(12) United States Patent
Hanson Allen et al.

(10) Patent No.: US 11,026,454 B2
(45) Date of Patent: Jun. 8, 2021

(54) FLOATING DARTS FOR SHAPEWEAR

(71) Applicant: Spanx, Inc., Atlanta, GA (US)

(72) Inventors: Wendy Hanson Allen, Atlanta, GA (US); Angelica Melendez, Atlanta, GA (US); Elena Novosiolova, Atlanta, GA (US); Deneb Torano, Atlanta, GA (US)

(73) Assignee: Spanx, Inc., Atlanta, GA (US)

( * ) Notice: Subject to any disclaimer, the term of this patent is extended or adjusted under 35 U.S.C. 154(b) by 90 days.

(21) Appl. No.: 16/174,900

(22) Filed: Oct. 30, 2018

(65) Prior Publication Data

US 2019/0124998 A1 May 2, 2019

Related U.S. Application Data

(60) Provisional application No. 62/578,869, filed on Oct. 30, 2017.

(51) Int. Cl.

| | |
|---|---|
| ***A41B 9/00*** | (2006.01) |
| ***A41B 17/00*** | (2006.01) |
| ***A41C 1/00*** | (2006.01) |

(52) U.S. Cl.

CPC ..... *A41B 9/001* (2013.01); *A41B 17/00* (2013.01); *A41C 1/003* (2013.01);
(Continued)

(58) Field of Classification Search

CPC ..... A41D 1/06; A41D 2400/38; A41D 1/08; A41D 13/0015; A41D 27/02; A41D 2300/22; A41D 13/0017; A41D 1/067; A41D 1/22; A41D 31/02; A41D 1/21; A41D 2300/50; A41D 2500/00; A41D 2500/10; A41D 2600/10; A41D 31/04; A41D 13/012; A41F 9/00; A41F 9/02; A41F 9/025; A41B 1/08; A41B 2400/38;
(Continued)

(56) References Cited

U.S. PATENT DOCUMENTS 738,677 A * 9/1903 Hammond ..... A41D 1/10 2/231
1,040,747 A * 10/1912 Page ..... A41D 1/10 2/231

(Continued)

OTHER PUBLICATIONS https://whileshenaps.com/2013/10/what-is-a-dart-and-how-are-darts-used-in-sewing-patterns.html; Glassenberg; Oct. 28, 2013. (Year: 2013).*

*Primary Examiner* — Robert H Muromoto, Jr.
(74) *Attorney, Agent, or Firm* — Meunier Carlin & Curfman LLC

(57) ABSTRACT

Shapewear enhances the appearance of areas of a wearer's body, including the abdominal region. Typical shapewear that targets the abdominal area is often uncomfortable, because it uses methods to provide additional control to the area that also decrease the flexibility of the fabric. The shapewear garment disclosed herein includes a region configured to cover the abdominal region of a wearer. The abdominal region of the shapewear garment includes at least one dart provided in the fabric. The fabric of the shapewear garment is a high-elasticity fabric containing from about 20% to about 60% elastane. The darts in the abdominal region increase the control in the targeted abdominal area without significantly decreasing the flexibility and comfort of the high-elasticity fabric.

19 Claims, 5 Drawing Sheets

(52) U.S. Cl.
CPC ..... *A41B 2400/22* (2013.01); *A41B 2400/38* (2013.01); *A41B 2500/10* (2013.01)

(58) Field of Classification Search
CPC ..... A41B 17/00; A41B 2400/62; A41B 11/00; A41B 11/005; A41B 11/02; A41B 9/001; A41C 1/00; A41C 1/02; A41C 1/08; A41C 3/0057; A41C 3/08; A41C 3/0007; A41C 3/12; A41C 3/124; A41C 3/128
See application file for complete search history.

(56) References Cited

U.S. PATENT DOCUMENTS 1,173,139 A * 2/1916 Abramson ..... A41D 1/06 2/227
1,578,970 A * 3/1926 Fritz Feser ..... A41D 1/10 2/231
2,019,545 A * 11/1935 Roth ..... A41B 9/06 2/73
2,023,701 A * 12/1935 Isidor ..... A41C 1/08 450/8
2,101,564 A * 12/1937 Sayour ..... A41D 1/22 2/93
2,115,146 A * 4/1938 Kops ..... A41C 1/08 450/9
2,394,541 A * 2/1946 Freedman ..... A41D 27/10 2/125
2,409,601 A * 10/1946 Truesdell ..... A41C 1/10 450/94
2,513,039 A * 6/1950 Miller ..... A41B 9/04 2/406
2,568,826 A * 9/1951 Roussos ..... A41D 1/22 2/244
2,663,025 A * 12/1953 Siegfried ..... A41D 1/06 2/221
2,705,324 A * 4/1955 Kleinman ..... A41C 1/00 450/136
2,716,754 A * 9/1955 Hirsch ..... A41D 1/08 2/227
2,788,524 A * 4/1957 Perrier ..... A41C 1/00 450/130
3,068,871 A * 12/1962 Rapp ..... A41D 1/06 450/95
3,080,863 A * 3/1963 Stolle ..... B29B 13/022 126/343.5 A
3,089,149 A * 5/1963 Kelleam ..... A41D 1/21 2/221
3,099,014 A * 7/1963 Smith ..... A41D 1/21 2/221
3,143,741 A * 8/1964 Tyroler ..... A41D 1/06 2/227
3,234,947 A * 2/1966 Bergstein ..... A41D 1/06 450/95
3,609,766 A * 10/1971 Olive ..... A41H 3/04 2/74
3,694,818 A * 10/1972 Nielson ..... A41H 31/00 112/475.09
3,763,498 A * 10/1973 Rector ..... A41D 13/012 2/2.15
3,765,095 A * 10/1973 Olive ..... A41H 3/04 33/14
3,812,540 A * 5/1974 Pagano ..... A41D 1/02 2/93
3,883,955 A * 5/1975 Bush ..... A41H 3/00 33/12
3,932,503 A * 1/1976 Weber ..... A61K 31/17 564/41
3,939,565 A * 2/1976 Bush ..... A41H 3/00 33/17 R
4,214,319 A * 7/1980 Bollag ..... A41D 1/02 156/93
4,599,812 A * 7/1986 Harmsen ..... A61F 13/085 2/239
4,890,337 A * 1/1990 Greenberg ..... A41D 1/06 2/220
4,989,272 A * 2/1991 Wagner ..... A41D 1/06 2/227
5,127,108 A * 7/1992 Weiss ..... A41D 1/06 2/220
5,144,697 A * 9/1992 Sandbeck ..... A41D 1/06 2/219
5,450,630 A * 9/1995 Hale ..... A41B 11/00 2/239
5,535,451 A * 7/1996 Tassone ..... A41D 1/06 2/227
5,784,721 A * 7/1998 Huff ..... A41B 11/02 2/239
5,888,118 A * 3/1999 Kishi ..... A41C 1/003 2/243.1
6,250,115 B1 * 6/2001 Suzuki ..... D04B 1/246 66/171
6,846,217 B1 * 1/2005 Struble ..... A41C 3/08 2/78.1
7,341,500 B2 * 3/2008 Horn ..... A41D 1/06 450/122
7,707,658 B2 * 5/2010 Culhane ..... A41D 1/067 2/227
7,845,021 B2 * 12/2010 del Carmen Erana Ahumada ..... A41B 9/001 2/227
7,861,323 B2 * 1/2011 Inagaki ..... A41D 1/089 2/227
7,874,018 B2 * 1/2011 Wheater ..... A41D 31/00 2/115
7,958,569 B2 * 6/2011 Razzaghi ..... A41D 13/0002 2/62
8,418,268 B2 * 4/2013 Waldman ..... A41D 1/06 2/248
8,491,514 B2 * 7/2013 Creighton ..... A61L 15/58 602/60
8,683,616 B2 * 4/2014 Zielinski ..... A41D 1/06 2/69
8,839,463 B2 * 9/2014 Fier ..... A41D 1/06 2/227
8,951,217 B2 * 2/2015 Joseph ..... A61F 5/05841 602/7
9,320,306 B2 * 4/2016 Freddi ..... A41D 1/06
9,468,239 B2 * 10/2016 Battah ..... A41D 27/02
9,801,420 B2 * 10/2017 Hays ..... A41D 1/06
9,955,741 B2 * 5/2018 Roup ..... A41D 1/067
9,968,139 B2 * 5/2018 Callahan ..... A41C 1/08
10,045,569 B2 * 8/2018 Caden ..... A41D 31/12
10,285,457 B2 * 5/2019 Roup ..... A41D 1/067
10,306,931 B2 * 6/2019 Inzer ..... A41B 1/08
2006/0200893 A1 * 9/2006 Boston ..... A41D 1/08 2/403
2008/0295217 A1 * 12/2008 Hendrickson ..... A41C 1/10 2/69
2009/0133182 A1 * 5/2009 Inagaki ..... A41D 1/089 2/404
2009/0172859 A1 * 7/2009 Clement ..... A41D 1/08 2/69
2012/0309265 A1 * 12/2012 Abrams ..... A41D 1/08 450/95
2013/0012853 A1 * 1/2013 Brown ..... A41C 3/0057 602/19
2013/0211302 A1 * 8/2013 Brown ..... A61F 5/026 602/19
2014/0114620 A1 * 4/2014 Grinspun ..... G06T 19/00 703/1
2014/0165265 A1 * 6/2014 Tulin ..... A41D 1/06 2/234
2016/0262460 A1 * 9/2016 Inzer ..... A41B 1/08
2018/0184726 A1 * 7/2018 Wesley ..... A41C 3/12
2019/0008226 A1 * 1/2019 Krivonosova ..... A41H 3/04

(56) References Cited

U.S. PATENT DOCUMENTS

| | | | | |
|---|---|---|---|---|
| 2019/0015233 | A1* | 1/2019 | Galloway | A61F 5/05816 |
| 2019/0320747 | A1* | 10/2019 | Otashevich | A41D 27/02 |
| 2019/0373971 | A1* | 12/2019 | Hiney | A41F 9/02 |

* cited by examiner

FLOATING DARTS FOR SHAPEWEAR

CROSS REFERENCE TO RELATED APPLICATIONS

This application claims the benefit of U.S. Provisional Application No. 62/578,869, filed Oct. 30, 2017, which is hereby incorporated by reference in its entirety for all purposes.

BACKGROUND

Shapewear is worn underneath outerwear to enhance a wearer's body shape. Shapewear garments are used to cover a wearer's abdominal area, providing smoothing and control to the area. However, there remains a need for lightweight, breathable shapewear that stays in place, is not visible through outerwear, and is still able to provide excellent shaping. Particularly, there remains a need for targeted placement of increased compression in garments with high stretch/elongation.

SUMMARY

The shapewear garments disclosed herein allow for precise control over the positioning of increased compression. The shapewear garments include darts in an abdominal region of the garment. The abdominal region includes a knit fabric, and the knit fabric contains from 20% to 60% elastane. One or more darts may extend at least partially across the abdominal region. The darts remove fabric from the abdominal region of the garment, increasing control in the abdominal region without substantially decreasing the flexibility or breathability of the fabric.

In some embodiments, the fabric contains from 30% to 40% elastane. In some embodiments, the shapewear garment includes one or more floating darts. In some embodiments, the shapewear garment includes a left dart and a right dart. In some embodiments, the left and right darts extend at a diagonal relative to a vertical center line of the garment. For example, each of the left and right darts can make an angle that ranges between 10 degrees and 30 degrees with the vertical centerline of the garment. In some embodiments, the left dart has a top point and a bottom point, and the right dart has a top point and a bottom point. In some embodiments, the distance between a top point of the left dart and a vertical center line of the shapewear garment is less than the distance between a bottom point of the left dart and the vertical center line, and the distance between the top point of the right dart and the vertical center line less than the distance between a bottom point of the right dart and the vertical center line. In some embodiments, the length of the left dart from the top point to the bottom point is from 2 to 8 inches, and the length of the right dart from the top point to the bottom point is from 2 to 8 inches. In some embodiments, the left and right darts include a zigzag stitch.

In some embodiments, a lower edge of the garment includes a raw edge. In some embodiments, the abdominal region has lower elasticity than the other regions of the garment. In some embodiments, the fabric in the abdominal region is 1-ply. In some embodiments, the shapewear garment includes a front panel and a back panel, and the back panel has a center seam. In some embodiments, the garment includes left and right leg portions. In some embodiments, the garment includes an elastic waistband above the abdominal region.

Methods of making a shapewear garment having darts in the abdominal area are also disclosed herein. Methods of making the shapewear garment can include the steps of providing a front side having an abdominal region and a back side. The front side and back side can include a knit fabric, and the knit fabric can contain from 20% to 60% elastane. The method can include joining the front and back sides to form a garment, and sewing a left dart and a right dart that extend at least partially across the abdominal region. In some embodiments, methods further include folding left and right fabric wedges to the interior of the front side of the garment before sewing the left and right darts. The left and right fabric wedges can be folded at an angle to the vertical centerline of the garment, the angle being between 10 degrees and 30 degrees. In some embodiments, methods further include cutting left and right fabric wedges from the front side of the garment before sewing the left and right darts.

DETAILED DESCRIPTION

Figure 1:
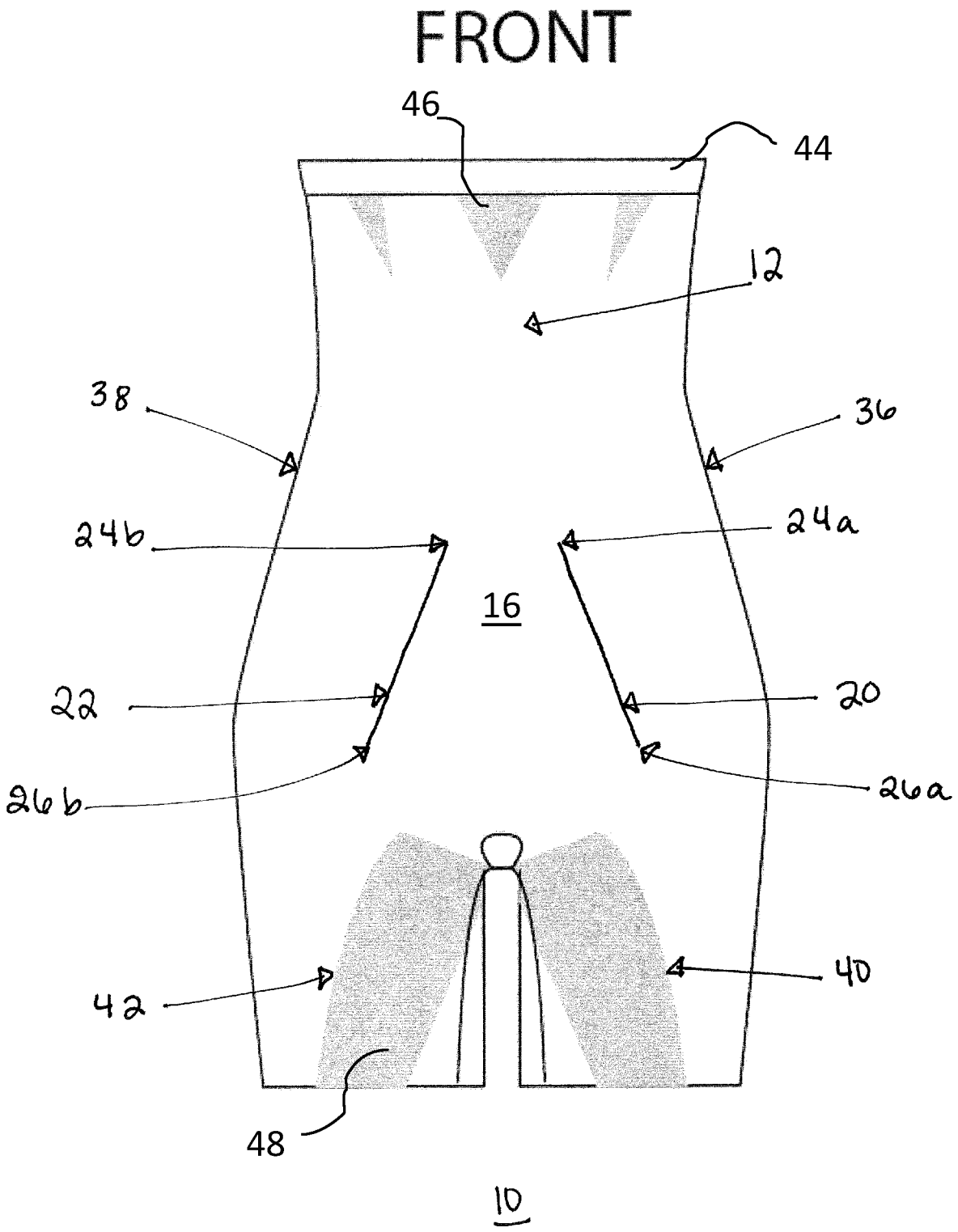
FIG. 1 is a front view of an embodiment of a shapewear garment having a left dart and a right dart.

Shapewear garments enhance a wearer's body shape by providing compression, control, and smoothing to certain areas. One area that many wearers use shapewear to target is the abdominal area. It is often desirable for shapewear to provide more compression or control to certain targeted areas than to other areas covered by the garment. The amount of compression and stretch of different areas of a shapewear garment can be controlled by adjusting the garment pattern at the side seams or back seam. However, manipulating the garment pattern only at the side seams and back seam does not always do enough to restrict stretch at a targeted position, such as the abdominal region. Current additional methods of targeting the abdominal area include boning, bonding, and providing extra panels in the targeted area. These methods often make a garment less comfortable in the targeted areas. They also increase the material and labor costs of making the garments. It is therefore advantageous to provide additional compression to targeted regions of shapewear garments, specifically the abdominal region, in a way that does not add bulk or stiffness to the garment or increase the manufacturing costs.

A shapewear garment is disclosed herein that includes floating darts in an abdominal region of the garment. The shapewear garment includes a front side and a back side, the front side having a region that at least partially covers an abdominal area of the wearer. The abdominal region of the garment is made from a knit fabric. The knit fabric includes from about 20% to about 60% elastane, which allows the fabric to have a high amount of stretch and elasticity. One or more darts extend at least partially across the abdominal region, taking in fabric from the region. The removal of the fabric from the abdominal region to create the darts restricts stretch and volume in the area, providing targeted control across the wearer's abdomen. Altering the shape of the abdominal region using darts instead of adding boning, bonding, or additional fabric panels is more comfortable for the wearer because the darts reduce the bulk of the fabric in the area without substantially decreasing the fabric's flexibility.

Darts are created by taking in or removing fabric from certain areas of the garment. Darts take in fabric from narrower areas of the body, and have one or more points extending toward a fuller area of the body. This allows a flat piece of fabric to conform to the three-dimensional shape of a wearer's body. In general, darts can either extend from the edge of a fabric panel of a garment, or can be formed in the middle of a fabric panel not intersecting an edge. Darts extending from the edge of a fabric panel are sometimes seen, for example, in the bust region of upper-body garments. A triangular or wedge-shaped section of material is removed, and the remaining edges bordering the removed section are stitched together. This creates shape in the bust area. In other garments, the darts are "floating darts," which are darts that do not begin at the edge of a fabric panel. Instead, the darts take in fabric from a more central area of a fabric panel. For example, darts can be used in a back panel of a jacket to create shape by taking in fabric at the waist area.

As used herein, fixedly attached is defined as attached via sewing or bonding. Seamlessly attached is defined as continuously formed as one stretch of fabric. Seamless attachment can be achieved by knitting two or more portions or panels of the undergarment together as one piece of fabric, such that there is no seam joining the portions. This can be achieved by using a seamless knitting machine, a hosiery machine, or other knitting machine. Seamless attachment can also be done by continuously forming two or more portions or panels as one stretch of woven or non-woven fabric.

Figure 2:
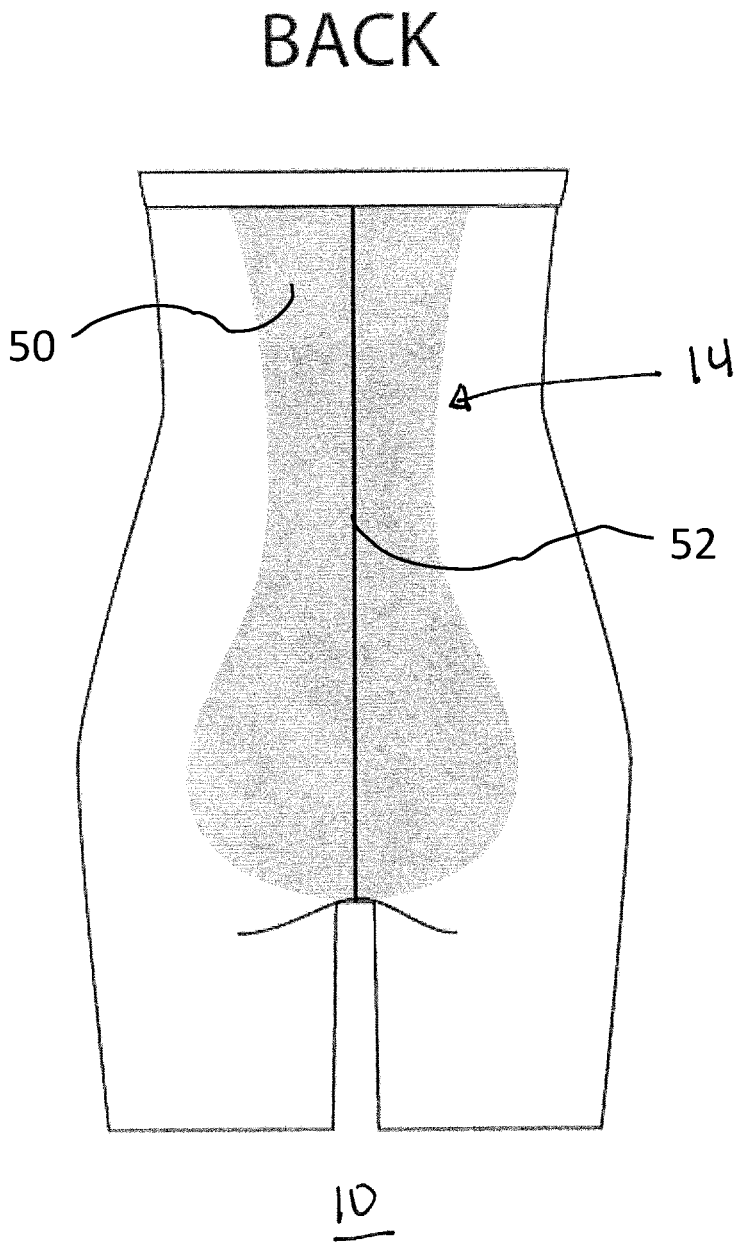
FIG. 2 is a back view of an embodiment of a shapewear garment.

In some embodiments, a shapewear garment is configured to compress the abdominals of a wearer. FIG. 1 illustrates the front side of an embodiment of a shapewear garment. FIG. 2 illustrates the back side of an embodiment of a shapewear garment. The shapewear garment 10 has a front side 12 and a back side 14. The front side 12 of the shapewear garment 10 has an abdominal region 16. The abdominal region 16 is a portion of the shapewear garment 10 that is configured to cover at least a portion of the abdominals of the wearer.

In some embodiments, the front side 12 and back side 14 are at least partially made from a knit fabric. In some embodiments, the abdominal region 16 is made from a knit fabric. In some embodiments, the knit fabric contains from about 20% to about 60% elastane. In some embodiments, the knit fabric contains from about 30% to about 40% elastane. The high elastane content of the knit fabric provides a large amount of stretch and elasticity to the fabric.

The abdominal region 16 has one or more darts extending at least partially across the abdominal region. In some embodiments, the abdominal region has a left dart 20 and a right dart 22. FIG. 1 is an illustration of a shapewear garment having a left dart 20 and a right dart 22. Left and right darts 20, 22 are floating darts, in that they do not extend from nor contact an edge of a fabric panel or a seam connecting two fabric panels. However, in other embodiments, one or more darts can extend at least partially across the abdominal region 16 from any point and, in any direction. For example, one or more darts may contact and extend from a left lateral side seam and/or a right lateral side seam.

Figure 3:
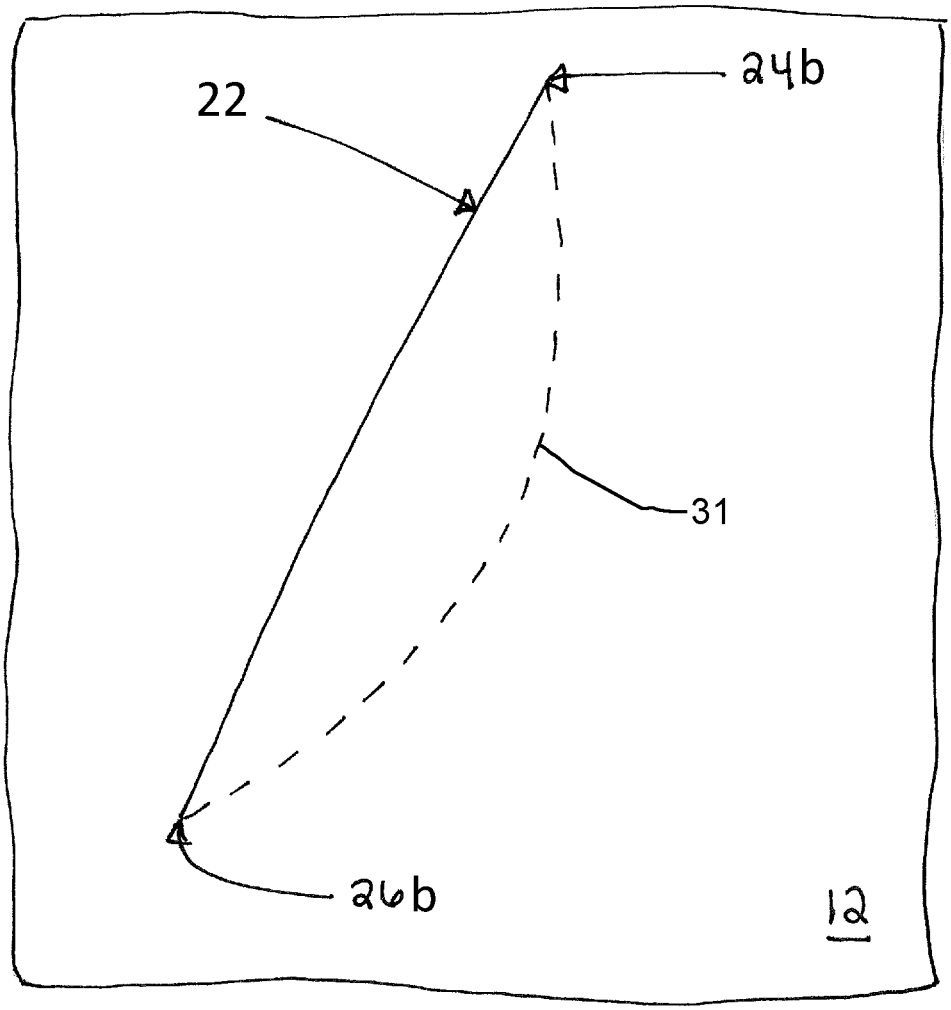
FIG. 3 is a close-up view of a dart from the exterior of a garment.

FIG. 3 is an illustration of a close-up view of a right dart 22 from the exterior side of the garment. The point, or apex, of a dart is the end of the dart. The right dart 22 shown in FIG. 3 has a top point 24*b* and a bottom point 26*b*. In some embodiments of the shapewear garment, the left dart has at least one point, and the right dart has at least one point. In some embodiments, the left dart has a top point and a bottom point. In some embodiments, the right dart has a top point and a bottom point. FIG. 1 illustrates a shapewear garment with a left dart 20 having a top point 24*a* and a bottom point 26*a*, and a right dart 22 having a top point 24*b* and a bottom point 26*b*. In some embodiments, the length of the left dart from the top point to the bottom point is from about 2 inches to about 8 inches. In some embodiments, the length of the right dart from the top point to the bottom point is from about 2 inches to about 8 inches. In some embodiments, the length of the left dart is equal to the length of the right dart. In some embodiments, the length of the one or more darts in a shapewear garment depends on the size of the garment. In some embodiments, the length of the one or more darts is dependent on the fabric elongation, the fabric modulus, and/or the anatomy of the wearer.

Figure 4:
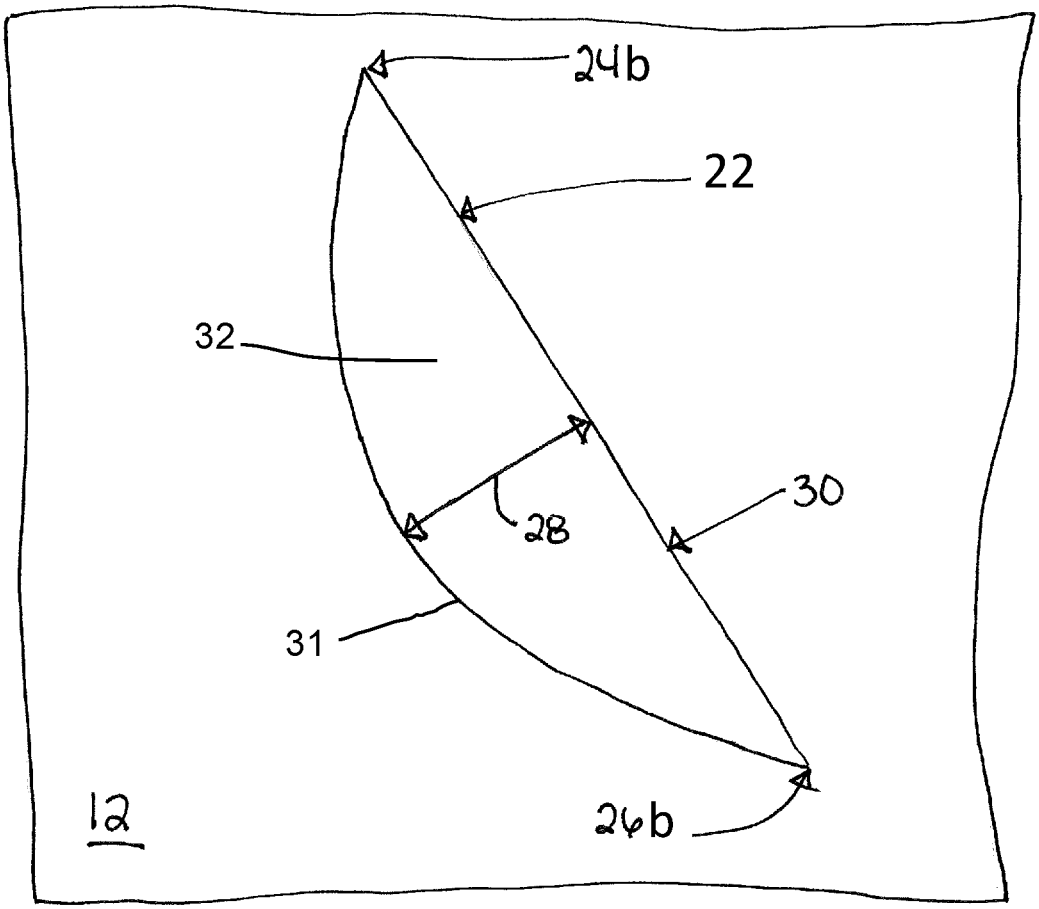
FIG. 4 is a close-up view of a dart from the interior of a garment.

In FIG. 3, the dotted line indicates where a fold 31 is located on the interior of the garment to take in the fabric. The fold 31 is not visible from the exterior of the garment. FIG. 4 illustrates the interior view of the dart 22, including seam 30 and fold 31. In some embodiments, the fabric wedge 32 that is taken in to create the dart 22 is cut or otherwise removed from the garment. As an alternative to cutting the fabric, a dart can be created by gathering or folding a portion of fabric at least partially located in the abdominal region 16 of the shapewear garment 10 and sewing the fabric along the gather or fold, such that the fabric wedge 32 that is taken in to create the dart 22 is left as part of the garment. Either way, the seam 30 attaches two formerly separated areas of the fabric to narrow the region.

The "intake" of a dart is the amount of fabric that is removed at the widest part of the dart. The intake is the distance between the seam 30 creating the dart and the fold 31 in the fabric, as shown in FIG. 4. In a dart having one point, the widest part of the dart is typically at the edge of the piece of fabric. In a dart having two points (as shown in FIGS. 3 and 4), the intake of the dart is located in between the top point and the bottom point. FIG. 4 illustrates a view of the right dart 22 from the interior of the garment. In the dart 22 shown in FIG. 4, the intake 28 is between the top point 24*b* and the bottom point 26*b*. In some embodiments of the shapewear garment 10, the widest part of the dart is located halfway between the top point and the bottom point. However, the position of the widest part of the dart can vary by anatomy, shape of the dart, and position of the dart on the garment.

In some embodiments, the width of intake 28 of the left dart 20 is from about 0.5 inches to about 2 inches. In some embodiments, the width of intake 28 of the right dart 22 is from about 0.5 inches to about 2 inches. However, the width of the intake can also depend, at least in part, on the anatomy and size of the intended wearer, the shape of the dart, and the position of the dart on the garment.

In some embodiments, the seam of the dart stretches with the fabric of the shapewear garment. In some embodiments, the thread used to create the seam 30 is polyester, cotton, nylon, or a blend thereof. In some embodiments, the seam 30 is a zig-zag stitch. In some embodiments, the seam 30 is a baby zig-zag stitch. In some embodiments, the zig-zag stitch is a 3-step zig zag stitch. In some embodiments, the seam 30 is an overlock stitch, a two-needle pull-out stitch, or a pearl marrow stitch.

Figure 5:
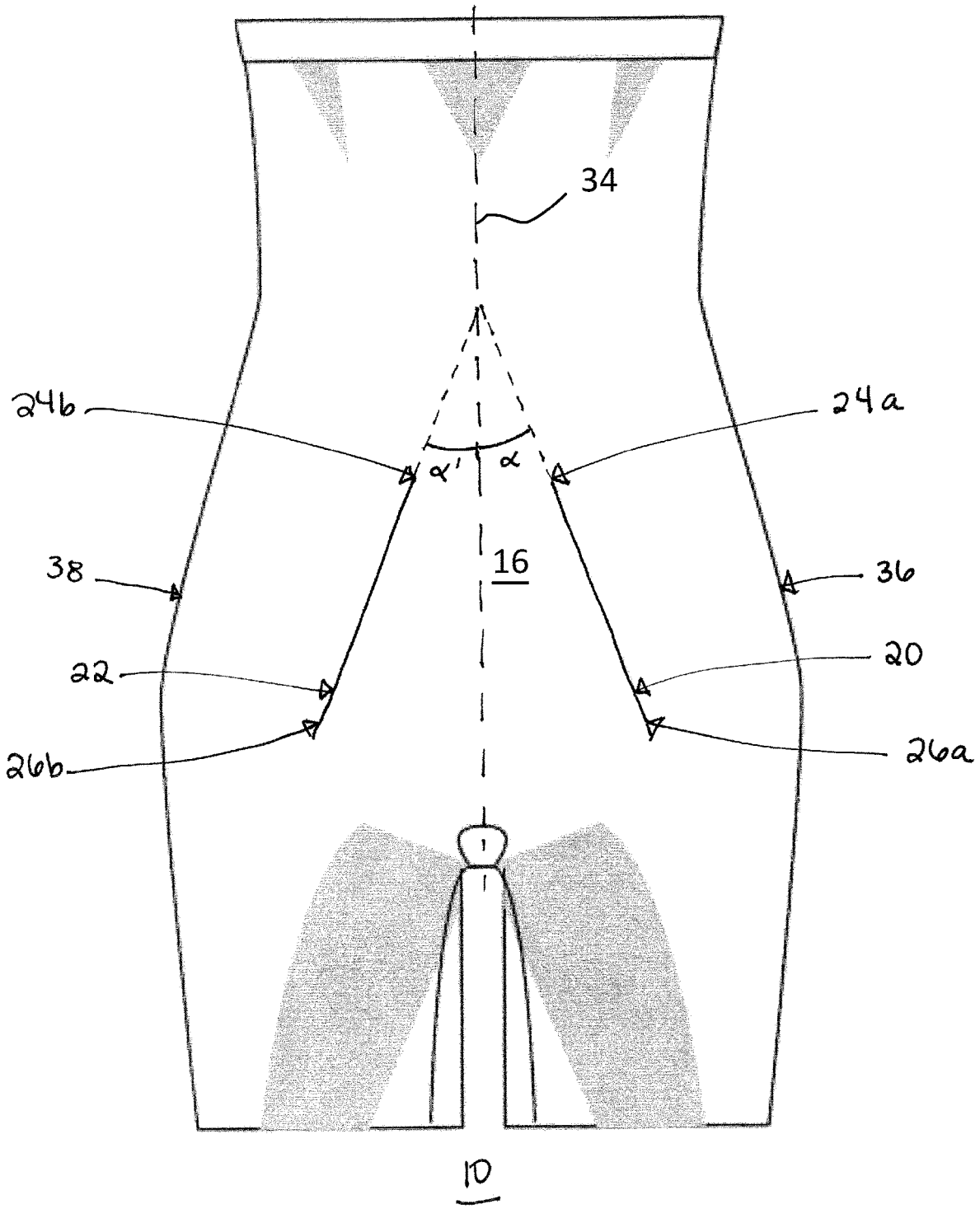
FIG. 5 is a view of an embodiment of a shapewear garment having a left dart and a right dart, showing the placement of the darts.

In some embodiments, the one or more darts are placed generally vertically on the garment. In some embodiments, the darts can extend across the abdominal region at a diagonal in any direction (relative to a vertical centerline of the garment). Referring to FIG. 5, in some embodiments, the left dart 20 and right dart 22 are placed an equal distance from a vertical center line 34 of garment 10. In some embodiments, the distance $d_{t1}$ between a top point 24*a* of the left dart 20 and a vertical center line 34 of the shapewear garment is less than the distance $d_{b1}$ between a bottom point 26*a* of the left dart and the vertical center line. In some embodiments, the distance $d_{t2}$ between a top point 24*b* of the right dart 22 and a vertical center line 34 is less than the distance $d_{b2}$ between a bottom point 26*b* of the right dart and the vertical center line. For example, in the embodiment illustrated in FIGS. 1 and 5, the top point 24*a* of the left dart 20 and the top point 24*b* of the right dart 22 are placed closer to the vertical center line 34 than the bottom point 26*a* of the left dart 20 and bottom point 26*b* of the right dart 22. The darts are therefore placed diagonally on the abdominal region 16 of the shapewear garment 10. FIG. 5 illustrates an axis extending from the left dart 20, creating an angle $\alpha$ with the vertical center line 34, and an axis extending from the right dart 22, creating an angle $\alpha'$ with the vertical center line 34. In some embodiments angles $\alpha$ and $\alpha'$ can each range from about 1 to about 50 degrees, including about 1 degree, about 5 degrees, about 10 degrees, about 15 degrees, about 20 degrees, about 25 degrees, about 30 degrees, about 35 degrees, about 40 degrees, about 45 degrees, and about 50 degrees. For example, angles $\alpha$ and $\alpha'$ can be between about 10 degrees and about 30 degrees. In the embodiment shown in FIG. 5, angles $\alpha$ and $\alpha'$ are about 20 degrees. In some embodiments, left and right darts 20, 22 can be placed such that they are parallel to at least a portion of the left and right edges of the garment 36, 38. For example, the darts can be parallel to the tapered edges between the hip and waist.

The shapewear garment 10 can be any type of garment configured to cover a wearer's abdominal area. In some embodiments, such as the embodiment shown in FIG. 1, the shapewear garment 10 has a left leg portion 40 and a right leg portion 42. In some embodiments, the shapewear garment 10 does not have a left leg portion or a right leg portion. In some embodiments, the shapewear garment 10 is a lower-body garment. In some embodiments, the shapewear garment 10 is an upper body garment. An upper body garment can be any upper body garment known in the art, including camisoles, slips, tanks, short-sleeve garments, long-sleeve garments, pull-on corsets/waist cinchers, step-in corsets/waist cinchers, bodysuits or any other upper body garment or top. In some embodiments, a lower edge of the garment is raw cut. A raw cut edge does not have a seam or bonding along the edge.

In some embodiments, the entire shapewear garment 10 is made from fabric having generally the same elasticity and weight throughout. In some embodiments, the abdominal region 16 has lower elasticity than other regions of the garment. In some embodiments, the abdominal region 16 has higher elasticity than other regions of the garment. In some embodiments, the abdominal region 16 is 1-ply fabric. In some embodiments, the elasticity of the abdominal region 16 in the vertical direction is greater than the elasticity in the horizontal direction. In some embodiments, the elasticity of the abdominal region 16 in the horizontal direction is greater than the elasticity in the vertical direction. In some embodiments, the abdominal region has balanced four-way stretch.

The shapewear garment 10 can be the same fabric throughout, it can have regions with different fabrics, or it can be one fabric with different types of stitches in different regions. For example, the embodiment shown in FIG. 1 has areas 46, 48 formed using different knit stitches. The areas can be placed in regions where high breathability is desired, for example, below the waistband 44 or on the inner thighs. For example, the garment shown in FIG. 1 has a right leg portion 40 and a right leg portion 42, and has areas 48 with different knit stitches on an inner thigh area of the left and right leg portions.

In some embodiments, the front side 12 is formed of a first fabric panel, the back side 14 is formed of a second fabric panel, and the first and second panels are joined at side seams of the garment. In some embodiments, such as the one shown in FIG. 2, the front side and the back side are formed from one fabric panel that is joined at the vertical center seam 52 on the back side of the garment. In some embodiments, the shapewear garment has a region of lighter-weight fabric 50 along a vertical center line of the back side. An elastic band can be attached to the vertical back center seam 52. In some embodiments, the front side and the back side are formed seamlessly.

Also disclosed herein is a method of making a shapewear garment having an abdominal region and at least one dart. A method of making a shapewear garment includes the steps of providing a front side with an abdominal region and a back side, where the front side and the back side include a knit fabric containing from about 20% to about 60% elastane. The method further includes joining the front side and the back side at the sides of the panels to form a garment and sewing at least one dart extending at least partially across the abdominal region. In some embodiments, the method includes sewing a left dart and a right dart at least partially across the abdominal region. In some embodiments, the method includes providing a front side and a back side that are seamlessly connected. In some embodiments, the method includes providing a separate front side and back side and attaching the front side to the back side. In some embodiments, the method includes sewing the front side to the back side. In some embodiments, the method includes bonding the front side to the back side. In some embodiments, the method further includes providing a left leg portion and a right leg portion.

The invention claimed is:

1. A shapewear garment configured to compress the abdominals of a wearer, the shapewear garment comprising:

an abdominal region comprising a knit fabric, wherein the knit fabric comprises from 20% to 60% elastane, one or more darts extending at least partially across the abdominal region;

wherein the dart comprises a seam joining two edges of the knit fabric or a seam securing a fold in the knit fabric, wherein the one or more darts narrow the abdominal region, wherein the one or more darts linearly extend out at a diagonal in a proximal to distal direction relative to a vertical centerline of the garment, wherein the garment comprises a left leg portion and a right leg portion and wherein the garment comprises one knit fabric, at least a portion of the left leg portion and at least a portion of the right leg portion includes a first type of knit stitch and at least another portion of the left leg portion and the right leg portion comprises a second type of knit stitch, wherein the first type of knit stitch and the second type of knit stitch are different.

2. The shapewear garment of claim 1, wherein the knit fabric comprises from 30% to 40% elastane.

3. The shapewear garment of claim 1, wherein the one or more darts are floating darts.

4. The shapewear garment of claim 1, wherein the abdominal region comprises a left dart and a right dart.

5. The shapewear garment of claim 4, wherein the left dart has a top point and a bottom point, and wherein the right dart has a top point and a bottom point.

6. The shapewear garment of claim 4, wherein the distance between a top point of the left dart and a vertical center line of the shapewear garment is less than the distance between a bottom point of the left dart and the vertical center line, and the distance between the top point of the right dart and a vertical center line of the shapewear garment is less than the distance between a bottom point of the right dart and the vertical center line of the shapewear garment.

7. The shapewear garment of claim 4, wherein the length of the left dart from the top point to the bottom point is from 2 to 8 inches, and the length of the right dart from the top point to the bottom point is from 2 to 8 inches.

8. The shapewear garment of claim 4, wherein the left and right darts comprise a zigzag stitch.

9. The shapewear garment of claim 4, wherein the left and right darts each make an angle with a vertical centerline of the garment that ranges between 10 degrees and 30 degrees.

10. The shapewear garment of claim 1, wherein a lower edge of the garment is a raw edge.

11. The shapewear garment of claim 1, wherein the abdominal region has lower elasticity than the other regions of the garment.

12. The shapewear garment of claim 1, wherein the abdominal region is 1-ply.

13. The shapewear garment of claim 1, further comprising a front panel and a back side, wherein the back side has a center seam.

14. The shapewear garment of claim 1, further comprising an elastic waistband positioned above the abdominal region.

15. A method of making a shapewear garment configured to compress the abdominals of a wearer, the method comprising:

providing a front side having an abdominal region and a back side; the front side and the back side comprising a knit fabric, wherein the knit fabric comprises from 20% to 60% elastane;

joining the front and back sides to form a garment;

sewing a left dart and a right dart extending at least partially across the abdominal region;

wherein the dart comprises a seam joining two edges of the knit fabric or a seam securing a fold in the knit fabric, wherein the one or more darts narrow the abdominal region, wherein the one or more darts linearly extend out at a diagonal in a proximal to distal direction relative to a vertical centerline of the garment, wherein the garment comprises a left leg portion and a right leg portion and wherein the garment comprises one knit fabric, at least a portion of the left leg portion and at least a portion of the right leg portion includes a first type of knit stitch and at least another portion of the left leg portion and the right leg portion comprises a second type of knit stitch, wherein the first type of knit stitch and the second type of knit stitch are different.

16. The method of claim 15, further comprising folding left and right fabric wedges to the interior of the front side of the garment prior to sewing the left and right darts.

17. The method of claim 16, wherein folding left and right fabric wedges further comprises folding at an angle of between 10 degrees and 30 degrees to a vertical centerline of the shapewear garment.

18. The method of claim 16, further comprising cutting left and right fabric wedges from the front side of the garment prior to sewing the left and right darts.

19. The shapewear garment of claim 1, wherein the garment comprises a fabric that is the same throughout.

* * * * *